United States Patent [19]

Ruf

[11] 4,005,953

[45] Feb. 1, 1977

[54] PISTON OF A ROTARY PISTON ENGINE OF TROCHOID TYPE, HAVING AN INTERNAL SEAL

[75] Inventor: Max Ruf, Obereisecheim, Germany

[73] Assignee: Audi NSU Auto Union Aktiengesellschaft, Neckarsulm, Wurtt, Germany

[22] Filed: Oct. 16, 1975

[21] Appl. No.: 622,962

[30] Foreign Application Priority Data

Oct. 18, 1974 Germany ..... 2449619

[52] U.S. Cl. ..... 418/142; 277/86; 277/193

[51] Int. Cl.[2] ..... F04C 27/00

[58] Field of Search ..... 418/142; 277/86, 87, 277/192, 193, 194, 197, 198

[56] References Cited

UNITED STATES PATENTS

| | | | |
|---|---|---|---|
| 3,506,275 | 4/1970 | Moriyama | 418/142 X |
| 3,796,436 | 3/1974 | Kurio et al. | 418/142 X |
| 3,797,976 | 3/1974 | Moriya et al. | 418/142 |
| 3,843,283 | 10/1974 | Wilmers | 418/42 |

FOREIGN PATENTS OR APPLICATIONS

| | | | |
|---|---|---|---|
| 1,813,297 | 6/1970 | Germany | 418/142 |

*Primary Examiner*—C. J. Husar
*Assistant Examiner*—Leonard Smith
*Attorney, Agent, or Firm*—Kane, Dalsimer, Kane, Sullivan and Kurucz

[57] ABSTRACT

A piston of a rotary piston engine of trochoid type including an internal seal with a scraper ring of L-shaped cross section arranged axially movable in a concentric annular groove in one end wall of the piston and pressed with spring action against the adjacent end wall of the housing. The scraper ring is sealed off inside the annular groove by an elastic sealing ring arranged between the axial flange of the scraper ring and at least one wall of the groove. The elastic sealing ring consist of two closed metal rings immediately adjacent to each other and having their outer periphery in sealing and axially displaceable contact with the radial flange of the scraper ring. The rings are inserted with a radial play between their inner periphery and the radial inner wall of the annular groove smaller than the radial play between the axial flange and the radial outer wall of the groove. A spring ring is arranged between the radial flange of the scraper ring and the metal rings, pressing the scraping edge of the scraper ring axially against the end wall of the housing and the metal rings axially against each other and sealingly against the bottom of the annular groove.

3 Claims, 2 Drawing Figures

PISTON OF A ROTARY PISTON ENGINE OF TROCHOID TYPE, HAVING AN INTERNAL SEAL

BACKGROUND OF THE INVENTION

The invention relates to a piston of a rotary piston engine of trochoid type, having an internal seal with a scraper ring of L-shaped cross section arranged axially movable in a concentric annular groove in one face of the piston and held by spring action against the adjacent end wall of the housing, the scraper ring being sealed inside the annular groove by an elastic sealing ring arranged between the axial flange of the scraper ring and at least one wall of the groove.

In pistons of the kind described, the function of such internal seals is to seal off the piston against the end wall of the housing so as to prevent passage of coolant or lubricant radially outward not only along the end wall of the housing but also through the annular groove. For this purpose, in known internal seals the scraper ring is sealed off inside the annular groove using a sealing ring of elastomer material arranged between the axial flange of the scraper ring and one wall of the groove. This solution, however, leads to an unsatisfactory result because the elastomer material of the sealing ring becomes hard and stiff in prolonged service because of insufficient heat endurance, thus losing its geometrical stability and elasticity. As a result, the necessary mobility of the scraper ring is inhibited, thus limiting and failing to ensure the sealing function of the internal seal in the long run.

To avoid a seal depending on rubber elasticity of this kind, it is known that a scraper ring may be sealed off radially against one wall of the groove by means of a ring of metal spring material, C-shaped in cross section. In this version, however, it may happen that the radial oscillations of the scraper ring, due to the motions of the piston, are transmitted to the C-shaped ring and possibly curtail its service life, since the requisite elasticity of the C-shaped ring is limited by the small structural depth available in the annular groove.

SUMMARY OF THE INVENTION

The object of the invention is to provide a piston having an internal seal of the kind initially mentioned, with a metallic seal between the scraper ring and the annular groove in the piston, and performing its sealing function properly both in axial movements of the piston relative to the end wall of the housing and in radial oscillations of the scraper ring.

This object is accomplished, according to the invention, in that the elastic sealing ring consists of two closed metallic rings immediately adjacent to each other. The outer periphery of the rings make sealing contact, axially displaceable, with the axial flange of the scraper ring. The inner periphery of the rings are inserted with radial play, relative to the radially inner wall of the annular groove, smaller than the radial play between the axial flange and the radially outer wall of the groove. A spring ring is attached between the radial flange of the scraper ring and the metallic rings with the spring ring pressing the scraping edge of the scraper ring axially against the end wall of the housing and the metal rings axially against each other and sealing against the bottom of the annular groove.

In such an arrangement, there is a sealing action of the sealing ring inside the annular groove in a radial and an axial plane with a closed sealing boundary in each instance, enabling the scraper ring to execute movements relative to the piston in axial direction and independently in radial direction together with the metal rings. The closed construction of the metal rings, unlike slit sealing rings, prevents collapse of the sealing ring in case of radial oscillations of the scraper ring, so that a constantly sealing contact with the scraper ring is achieved. In radial oscillations of the scraper ring, the metal rings, owing to the radial play provided, are able to bear together with the scraper ring on the radially inner wall of the annular groove, while the axial flange of the scraper ring is unable to touch the radially outer wall of the groove, owing to the greater radial play in this region. Such a centering of the scraper ring serves to prevent the metal rings from losing contact with and lifting off of the scaper ring under the influence of the continual radial accelerations.

An improvement of the radial contact of the metal rings with the scraper ring can be achieved without impairing the effect of sealing against the annular groove by providing the metal rings with recesses in radial direction on alternate sides and placing them side by side, secured against rotation, with the recesses of one metal ring offset from those of the other metal ring, so that the recesses are reciprocally covered. By reason of these recesses, the closed rings are able to assume an increased external tension as well as an elasticity in radial direction. With the comparatively small surface pressure at the sealing contact between the metal rings and the scraper ring thus obtainable, the axial mobility of the scraper ring can be favorably influenced. The staggered arrangement of the recesses in the metal rings can in large measure prevent passage of the medium to be sealed off.

To secure the sealing contact of the metal rings with the bottom of the annular groove, the bottom of the groove may have an annular recess in the region of the axial flange of the L-shaped scraper ring. By virtue of this annular recess, the scraper ring can execute axial movements without touching the bottom of the groove.

BRIEF DESCRIPTION OF THE DRAWINGS

An embodiment of the invention is explained below with reference to the drawing by way of example.

DESCRIPTION OF THE PREFERRED EMBODIMENTS

Figure 1:
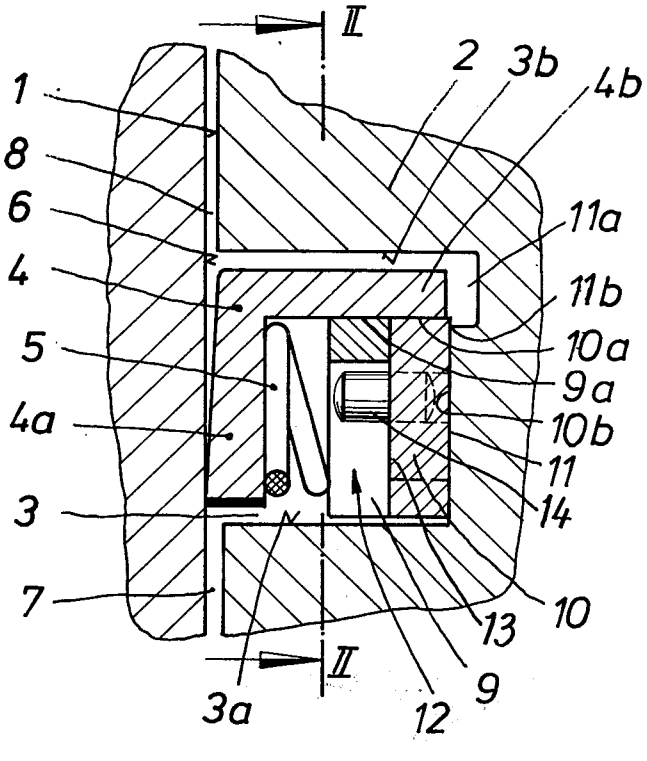
FIG. 1 shows a section of part of a piston end wall with internal seal according to the invention and an adjacent end wall of the housing.

Reference is first made to FIG. 1, in which, in a face 1 of a piston end wall 2, a concentric annular groove 3 is provided, in which a scraper ring 4 of L-shaped cross section is inserted axially movable. The scraper ring 4 is held by an axially acting spring ring 5, in contact with its radial flange 4*a*, against the adjacent end wall 6 of the housing, to prevent coolant or lubricant from leaking out of the space 7 radially outward along the end wall 6 of the housing into the space 8 and thence into the working chamber. The scraper ring 4 is sealed off inside the annular groove 3 by an elastic sealing ring consisting of two closed metal rings 9 and 10 immediately adjacent to each other. The two metal rings 9 and 10 firstly have their outer periphery 9*a*, 10*a* in sealing and axially displaceable contact with the axial flange 4*b* of the scraper ring 4, and secondly are pressed by the axially acting spring ring 5 against each other and, on a radial face 10*b* of metal ring 10, sealingly against the bottom 11 of the annular groove 3, in order also to prevent leakage of coolant or lubricant out of space 7 through annular groove 3 into space 8 and thence into the working chamber.

Figure 2:
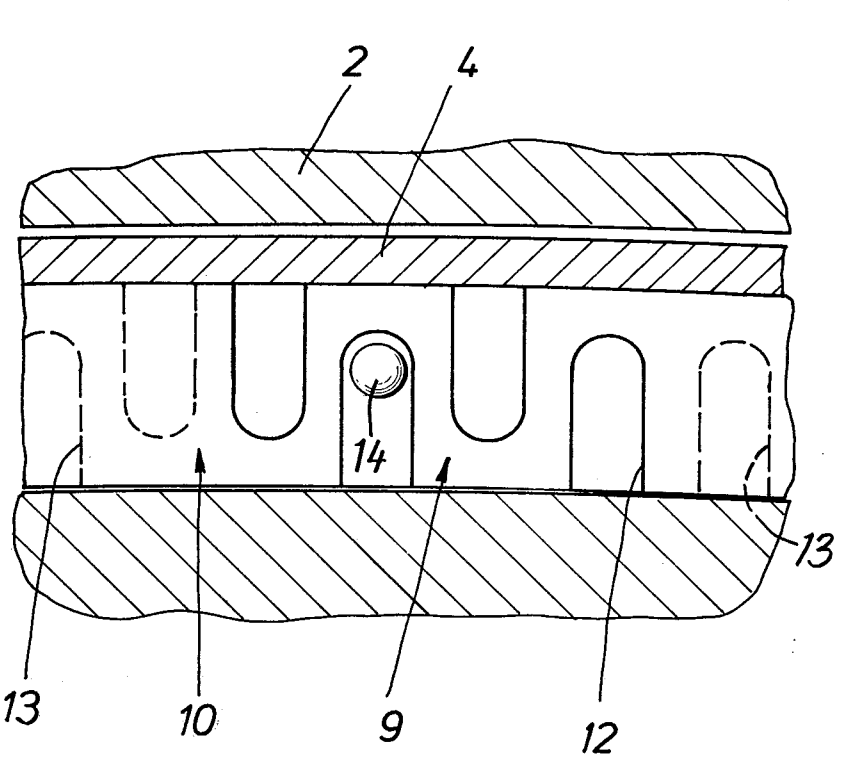
FIG. 2 shows a partial view of a section at the line II—II in FIG. 1.

As may be seen in FIG. 2, the two metal rings 9 and 10, in order to achieve an elasticity acting in radial direction in relation to the axial flange 4*b* of scraper ring 4, have recesses 12, and 13, respectively, cut alternately in radial direction. The two metal rings 9 and 10 are secured against rotation relative to each other by a pin 14 to prevent losses of coolant or lubricant with the recesses 12 of one metal ring 9 being offset from the recesses 13 of the other metal ring 10 so that recesses 12 are covered by metal ring 10 and recesses 13 are covered by metal ring 9.

The bottom 11 of the groove has an annular recess 11*a* in the region of the axial flange 4*b* of the scraper ring 4. The inner peripheral edge 11*b* of the recess 11*a* is of smaller diameter than the outer periphery 9*a*, 11*a* of the metal rings 9 and 10. This prevents the axial flange 4*b* from hitting the bottom 11 of the groove and being restricted in its mobility when the scraper ring 4 executes axial movement relative to the metal rings 9 and 10 in contact with the bottom 11 of the groove. To ensure a complete seal, the recess 11*a* does not extend all the way to the recesses 13.

The radial centering of the scraper ring 4 is effected by way of the metal rings 9 and 10, which are inserted with a radial play, relative to the radially inner wall 3*a* of the groove, smaller than the radial play between the axial flange 4*b* of the scraper ring 4 and the radially outer wall 3*b* of the groove.

The metal rings 9 and 10 can thus bear on the radially inner wall 3*a* of the annular groove 3 in radial oscillations of the scraper ring 4. Within the available play, the metal rings 9 and 10 can execute radial movements, sliding on the bottom 11 of the groove, together with the scraper ring 4, without thereby permitting leakage by way of the recesses 12.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. Piston of a rotary piston engine of trochoid type having a housing, comprising; an internal seal with a scraper ring of L-shaped cross section arranged axially movable in a concentric annular groove in one end wall of the piston and pressed with spring action against the adjacent end wall of the housing, the scraper ring being sealed off inside the annular groove by an elastic sealing ring arranged between the axial flange of the scraper ring and at least one wall of the groove, the elastic sealing ring consists of two closed metal rings immediately adjacent to each other and having their outer periphery in sealing and axially displaceable contact with the axial flange of the scraper ring, and inserted with a radial play between their inner periphery and the radially inner wall of the annular groove smaller than the radial play between the axial flange and the radially outer wall of the groove, a spring ring arranged between the radial flange of the scraper ring and the metal rings, pressing the scraping edge of the scraper ring axially against the end wall of the housing and the metal rings axially against each other and sealingly against the bottom of the annular groove.

2. Piston according to claim 1, wherein the metal rings have recesses cut into them in alternate radial directions, and lie side by side secured against rotation so that the recesses of one metal ring are offset from those of the other metal ring in such manner that the recesses are reciprocally covered.

3. Piston according to claim 1, wherein the bottom of the annular groove has an annular recess in the region of the axial flange of the L-shaped scraper ring.

* * * * *